US005890530A

United States Patent [19]

Schmitt

[11] Patent Number: 5,890,530

[45] **Date of Patent: *Apr. 6, 1999**

[54] METHOD OF MAKING MMC COMPONENTS

[75] Inventor: Theodore N. Schmitt, Vienna, Austria

[73] Assignee: Electrovac, Fabrikation elektrotechnischer Spezialartikel Gesellschaft m.b.H., Klosterneuburg, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 668,058

[22] Filed: Jun. 19, 1996

[30] Foreign Application Priority Data

Jun. 21, 1995 [AT] Austria ..... 1065/95

[51] Int. Cl.[6] ..... B22D 19/00; B22D 19/02

[52] U.S. Cl. ..... 164/98; 164/97

[58] Field of Search ..... 164/97, 98

[56] References Cited

U.S. PATENT DOCUMENTS

| | | | |
|---|---|---|---|
| 5,007,475 | 4/1991 | Lanxide . | |
| 5,240,062 | 8/1993 | Langensiepen . | |
| 5,301,738 | 4/1994 | Newkirk . | |
| 5,361,824 | 11/1994 | Keck . | |
| 5,487,420 | 1/1996 | Newkirk | 164/98 |
| 5,505,248 | 4/1996 | Aghajanian et al. | 164/97 |

FOREIGN PATENT DOCUMENTS

| | | |
|---|---|---|
| 108 216 A1 | 5/1984 | European Pat. Off. . |
| 369931 | 5/1990 | European Pat. Off. . |
| 375 588 A1 | 6/1990 | European Pat. Off. . |
| 2294272 | 4/1996 | United Kingdom . |
| PCT/US91/03235 | 11/1991 | WIPO . |

*Primary Examiner*—Kuang Y. Lin
*Attorney, Agent, or Firm*—Henry M. Feiereisen

[57] ABSTRACT

Method of making MMC components by an infiltration process, with a preform (3) which is disposed inside a crucible (6) and, optionally, held by a preform holder (2), being placed inside a pressure container (1), wherein the atmosphere inside the pressure container (1) is changeable during the production process, and after the infiltration metal (4) has melted on, the preform (3) is contained inside a sealed atmosphere in the presence of an oxygen-binding material.

11 Claims, 4 Drawing Sheets

METHOD OF MAKING MMC COMPONENTS

BACKGROUND OF THE INVENTION

The invention relates to a method of making MMC components by an infiltration process, with the preform which is disposed inside a crucible and, optionally, held by a preform holder, being placed inside a pressure container, wherein the atmosphere inside the pressure container is changeable during the manufacturing process.

Composite materials can be infiltrated with molten metal by applying gas under pressure to thereby produce so called metal matrix composites (MMC) are formed. Prior to such an infiltration process, the metal must be heated above its melting point so as to be able to permeate into the preform of the composite material. At the temperatures generated herein, the oxygen in the surrounding air, however, reacts with the metal surface, forming oxides which are detrimental to the properties of the formed component. In addition, the preforms themselves can react with the oxygen in the air. As a result, substances, like oxides, oxynitrides, oxycarbides, or the like are formed in dependence on the composition of the preform. These substances which are formed mainly on the surface of the preform, may adversely affect the open porosity which is required for the infiltration process to work. Consequently, as a result of the growth of these oxide compounds, the diameter of the pores may decrease to such extent that the pressure created by gas is no longer sufficient to overcome the capillary forces acting on the liquid infiltration metal, so that the infiltration metal can no longer migrate into the preform. In the worst case scenario, the aforedescribed oxidation processes may even completely seal the open pores.

The reaction between preform material and air alters thus in addition the material properties of the preform, thereby effecting an unintentional alteration of the physical and thermal properties, on the one hand, and complicating or eliminating the reproducibility of the desired material properties of the composite.

In order to eliminate this drawback, there is the possibility to evacuate the preform before the infiltration metal is melted on, to thereby expel the oxygen from the pores.

In another known process, the air (and thus the oxygen) is expelled from the preform by an inert gas purge. This process, however, is rather unreliable and time-consuming since it takes a long time until the oxygen molecules are adequately purged from the pores of the preform or of the preform holder.

In summary, both these processes are complex and time-consuming.

SUMMARY OF THE INVENTION

It is therefore an object of the invention to provide a process of the aforementioned type for making MMC components which effectively prevents the negative impact of oxygen and which is easily carried out.

This object is realized in accordance with the invention by keeping the preform in a sealed atmosphere in the presence of an oxygen-binding material after the infiltration metal has been melted on.

As a consequence, the oxygen inside the sealed atmosphere, i.e. within the pores of the preform, in the cavities between the preform and preform holder, etc., is bound and its harmful effect is thus avoided.

In a preferred embodiment of the invention, the oxygen-binding material can be formed from materials such as e.g. graphite, carbon, or the like, and/or from metals such as e.g. zirconium, titanium, or the like.

Above a temperature of about 600° C., an intensive redox reaction develops in the presence of these materials whereby the oxygen within the sealed atmosphere is bound.

In this context, it may be particularly advantageous to utilize a porous oxygen-binding material exhibiting pores filled with $H_2$.

Apart from the reduction of oxygen, hydrogen is released at the same time, thereby enriching the sealed atmosphere with an inert gas.

According to another embodiment of the invention, it may be provided to form the oxygen-binding material as preform holder and, optionally, in addition, as a separate piece work upon the infiltration metal, and/or as a sheath surrounding a crucible.

An additional component can be eliminated if the preform holder itself is made from oxygen-binding material.

In accordance with another feature of the invention, the infiltration metal can be made from metals, such as e.g. aluminum, copper, magnesium, silicon, iron, titanium, or the like, or alloys thereof.

These metals are especially well adapted for the manufacture of MMC components.

According to a modification of the invention, the oxygen-binding material is only provided in certain regions.

Thus, sections of the workpieces can be made with different properties in a simple manner.

BRIEF DESCRIPTION OF THE DRAWING

The process according to the invention is discussed in greater detail with reference to the accompanying drawing, in which.

DETAILED DESCRIPTION OF PREFERRED EMBODIMENTS

Figure 1A:
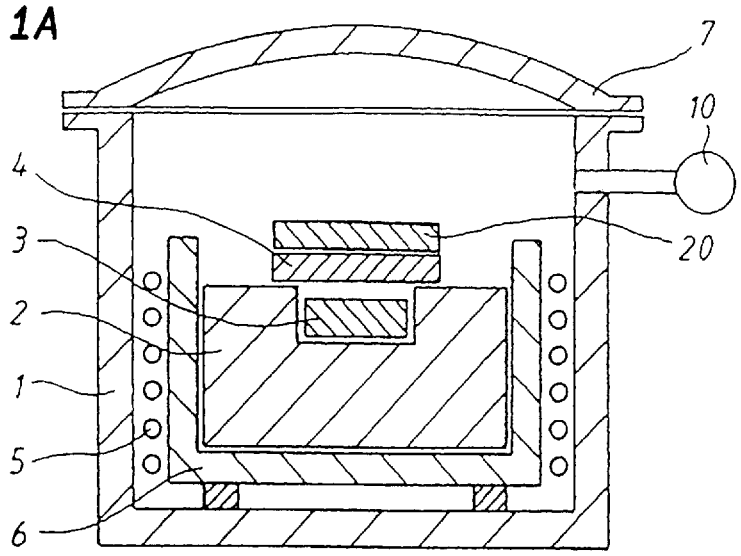
FIG. 1*a* is a vertical section of an apparatus for carrying out the process according to the invention.

FIG. 1*a* shows a pressure container 1 for making the MMC formed bodies. Disposed inside the pressure container 1 is a preform holder 2 for receiving the preform 3. The preform 3 is comprised of a reinforcing material which is arranged in a desired fashion. The entire arrangement is housed inside a crucible 6. The pressure container 1 can be sealed with a lid 7 to pressurize the container 1 from a pressure source 10.

A block or feeder 4 of infiltration metal is disposed on the rim of the preform holder 2. A heater 5 causes the metal to melt on. As soon as being liquefied, the metal completely covers the preform 3 as well as the preform holder 2 and bears upon the inner wall surface of the crucible 6. Thus, the preform 3 and the preform holder 2 are sealed off from the atmosphere prevalent inside the pressure container 1. This is required to press the liquid metal into the preform 3 through increase of the gas pressure inside the pressure container 1. In the event, a path would exist for permitting a penetration of gas between the interior space of the pressure container and the preform 3, a gas pressure increase within the pressure container 1 would result in an equal increase of the gas pressure inside the pores, thereby rendering an infiltration impossible.

After infiltration has concluded, the heater 5 is turned off and the metal is left to solidify under pressure.

Figure 4A:
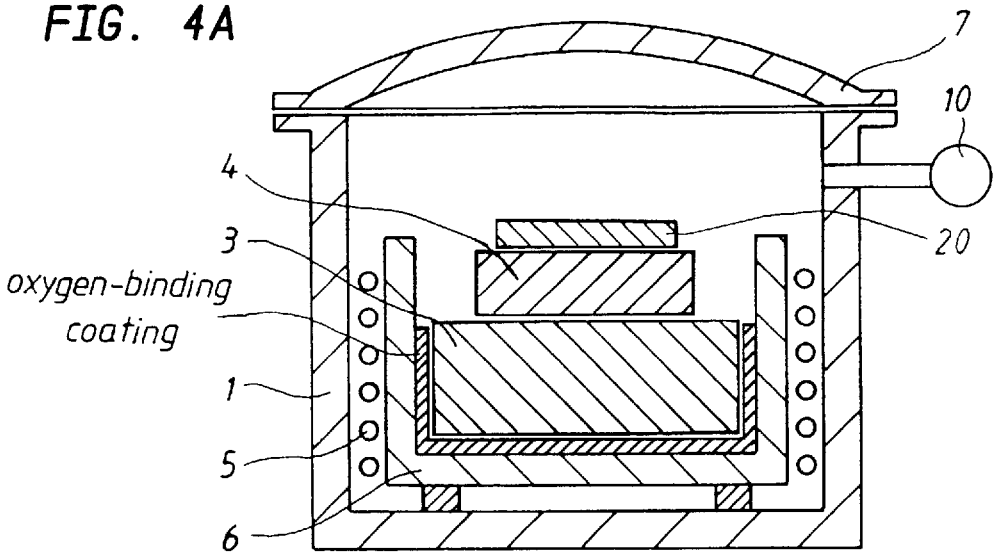
FIG. 4*a* is a vertical section of still another variation of the apparatus according to FIG. 1*a*.

The preform holder 2 is not a requirement, since the preform 3 may be positioned directly inside the crucible 6 as shown in FIG. 4*a*.

Figure 1B:
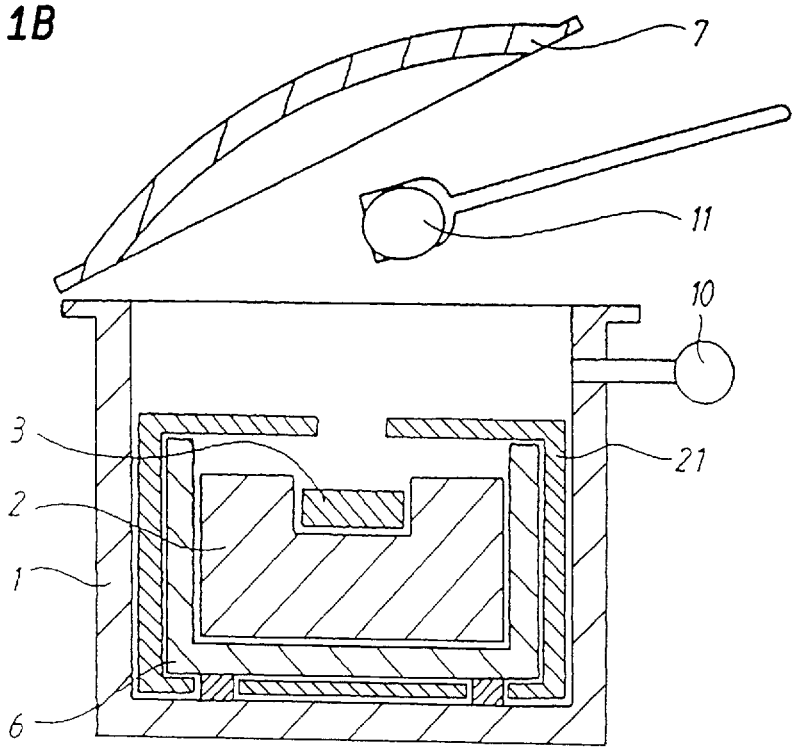
FIG. 1*b* is a vertical section of an alternate embodiment of the apparatus according to FIG. 1*a;*

FIG. 1*b* shows an alternate embodiment of the apparatus of FIG. 1*a*, with the heater being omitted. Here, the metal 11 which was melted at a different location, covers the preform 3; the lid 7 is closed, the inside of the pressure container 1 is pressurized by means of the pressure source 10, thereby pressing the liquid metal into the preform 3, and the metal is left to solidify.

Figure 2A:
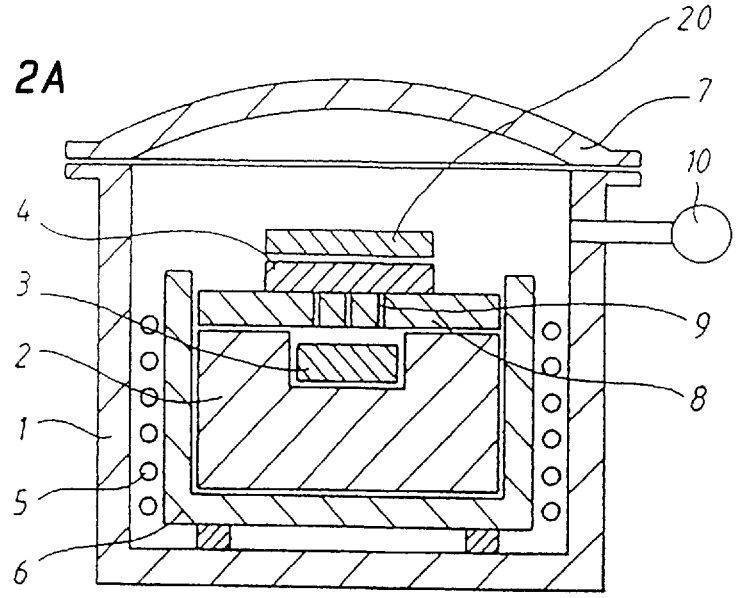
FIG. 2*a* is another embodiment of the apparatus according to FIG. 1*a;*

FIG. 2*a* represents a detail within the pressure container 1 of FIG. 1 in a different embodiment. Equivalent parts are given the same reference numbers.

A preform 3 is again positioned in a preform holder 2. A cover 8 with bores 9 rests on the preform holder 2, with the feeder 4 resting on the cover 8. The crucible 6 surrounds the preform holder 2 with its inserts and its caps. Through action of the heater 5; the infiltration metal melts, migrates through the bores 9 to the preform 3, and infiltrates the reinforcing material under applied pressure at closed lid 7.

Here again, it is important that the preform 3, preform holder 2 and cover 8 are sealed gastight by the liquid infiltration metal 4 from the surrounding atmosphere.

Figure 2B:
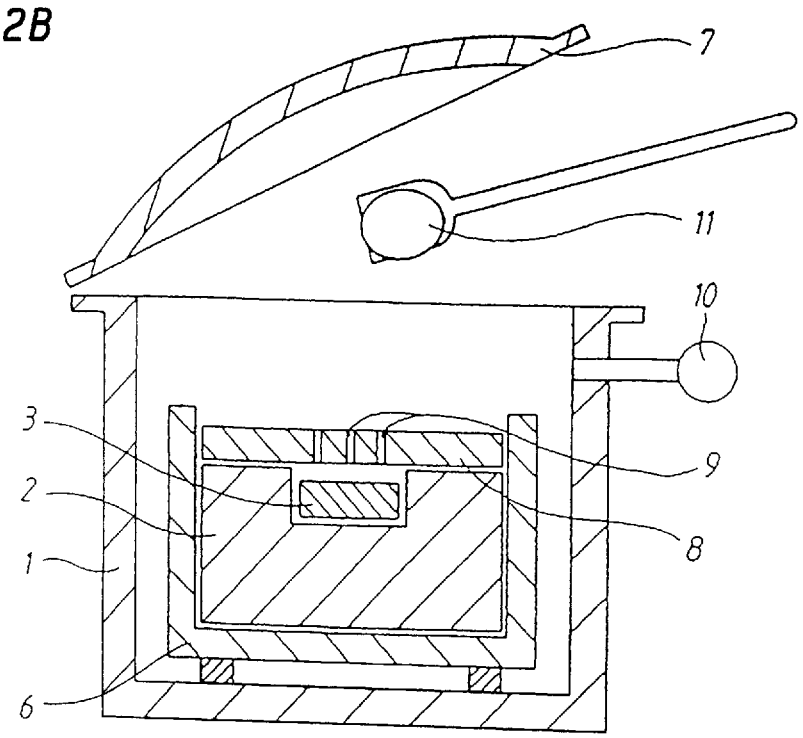
FIG. 2*b* is an alternative embodiment of the apparatus according to FIG. 2*a;*

FIG. 2*b* shows an alternate embodiment of FIG. 2*a*, whereby the heater has been omitted. Here, the metal 11 melted at a different location outside the pressure container 1 covers the cover 8; again, after the lid 7 is closed, the metal is pressed into the preform under pressure application by means of the pressure source 10 and left to solidify.

At the temperatures at which the infiltration metal 4 melts, the oxygen in the atmosphere inside the pressure container 1 reacts with the infiltration metal 4 and forms compounds which impair the properties of the component to be made.

The process according to the invention targets to maintain at least the preform 3 or—as in the embodiments shown in the Figures—the entire content of the crucible 6—i.e. the preform 3 and the preform holder 2—in a sealed atmosphere. Provided within the sealed atmosphere is an oxygen-binding material which at elevated temperatures—about 600° C. when using graphite—reacts with and binds the oxygen which is present within the sealed atmosphere, i.e. inside the pores of the preform 3, in the hollows between the preform 3 and the preform holder 2, etc. Thus, in accordance with the present invention, molten infiltration metal of any kind so covers the preform (and preform holder, when included in process) as to enclose the preform (and preform holder, when included in process) and the oxygen-binding material in a sealed atmosphere.

It is possible to wait for a certain period while keeping the temperature and the pressure constant between the time when the metal melts, i.e. the time when the crucible is hermetically sealed off, and the introduction of the overpressure in the container. On one hand, this ensures a uniform and complete heating of preform 3, preform holder 2, and infiltration metal 4; and, on the other hand, the reaction between graphite and oxygen can proceed long enough to sufficiently reduce the oxygen content.

Consequently, the oxygen can no longer exhibit the aforestated detrimental effect; the formation of parasitic oxygen compounds in the infiltration metal 4 and in the preform 3 is thus prevented.

Figure 4B:
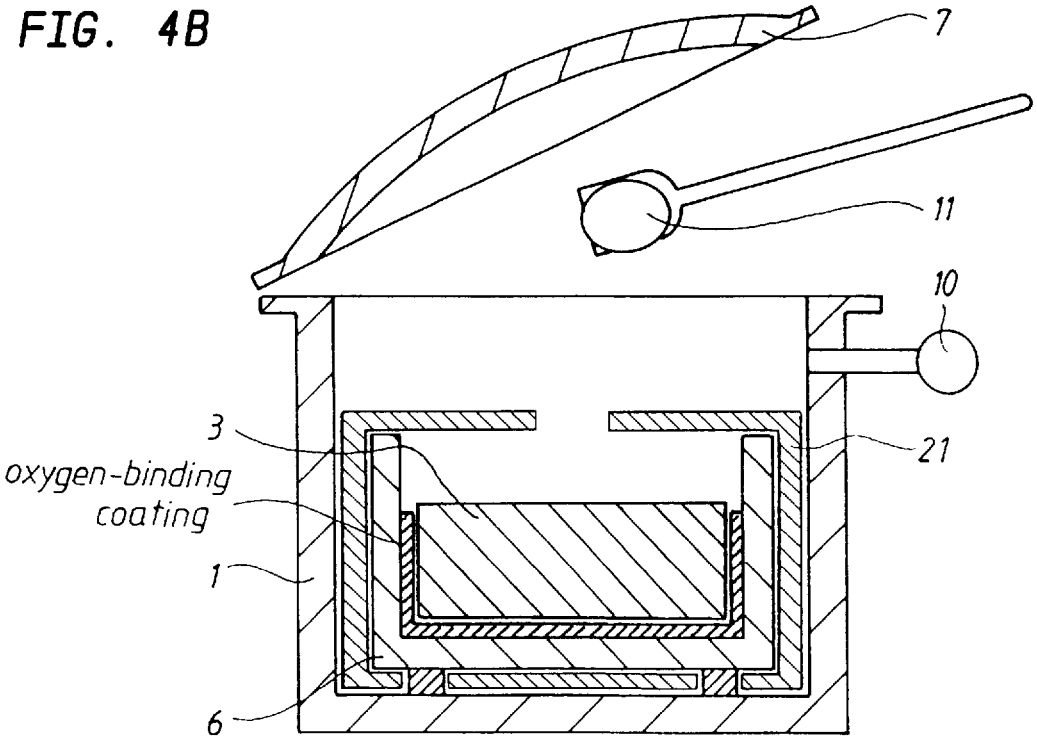
FIG. 4*b* is a vertical section of still another variation of the apparatus according to FIG. 1*b*.

The oxygen-binding material is either formed as the preform holder 2 itself, or possibly as an additional form piece 20 which is positioned above the infiltration metal 4 (FIG. 1*a* and 2*a*), or as a sheath 21 (FIG. 1*b*) surrounding the crucible 6. If no preform holder 2 is provided and if the preform 3 is placed directly inside crucible 6, then the inner wall of crucible 6 may be coated with oxygen-binding material in order to attain the same reducing action as with preform holder 2. This variation is shown in FIG. 4*b*. In this case, however, the gas permeability of the oxygen-binding material should be taken into account. As described above, the liquid infiltration metal 4, has to seal the preform 3 together with the oxygen-binding coating against the atmosphere in the pressure container. Should a porous coating extends through the surface of the liquid metal, then the seal of preform 3 would no longer be gastight.

The sheath 21 and the form piece 20 are not a requirement since both merely bind oxygen from the atmosphere in the pressure container. The arrangement of sheath 21 and form piece 20, however, is advantageous since a certain quantity of oxygen is already bound during the heat-up phase, while the infiltration metal 4 has not yet become liquid and has not yet sealed the preform 3 in a gastight manner from the atmosphere in the pressure container. After concluded sealing of the preform 3 from the surrounding atmosphere by the infiltration metal 4, the oxygen content in the pores of preform 3 is already diminished so that the remaining oxygen can be bound more rapidly and more completely.

The atmosphere in the pressure container 1 is formed preferably of ambient air; however, according to the invention, the atmosphere may also be formed by an inert gas or by an atmosphere at reduced pressure. In all situations, however, according to the invention, a sealed atmosphere is formed within crucible 6, with oxygen-binding materials binding the parasitic oxygen in this atmosphere.

The oxygen-binding materials may be made from graphite, carbon, or the like, but any other-oxygen-binding material can be employed. For example, certain metals with a high affinity for oxygen may be utilized. Examples herefor are zirconium, titanium, or the like.

It is especially advantageous to employ an oxygen-binding material which is porous—preferably titanium—and to fill its pores with $H_2$ before placement of the material inside the crucible 6. Such a material has during heating the effect of binding oxygen, while at the same time releasing the inert hydrogen. Such a material may be employed in addition to a preform holder 2 made from an oxygen-binding material, by e.g. incorporating a recess in the preform 2 for placement and a porous material placed into said recess.

The infiltration metal 4 may, depending on the properties required of the MMC component, be formed of metals, such as e.g. aluminum, copper, magnesium, silicon, iron, titanium, or the like, or alloys thereof. This list contains only some examples and any other suitable metal can be employed for carrying out the process according to the invention.

For certain MMC components, it is desirable that specific regions of the infiltration metal 4 are oxidized. According to the invention, such components may be made by arranging oxygen-binding material only in certain sections. For example, only one third of the surface of the infiltration metal 4 is covered with an oxygen-binding form piece 20 so that the oxidation processes can take place in the uncovered region of the infiltration metal 4, whereas oxidation processes in the covered region are averted.

An example for the necessity to provide an application for the aforedescribed local reducing action is subsequently described. Kovar, nickel-iron alloys, molybdenum, copper, etc., and alloys thereof tend to oxidize when heated in an oxygen-rich atmosphere. An oxide layer will form on the surface and components formed from these materials can be joined to other components only with difficulty or not at all. If components made from such materials should also be cast during the infiltration process, it is thus necessary to protect at least these components from oxidation through local arrangement of oxygen-binding material.

Figure 3A:
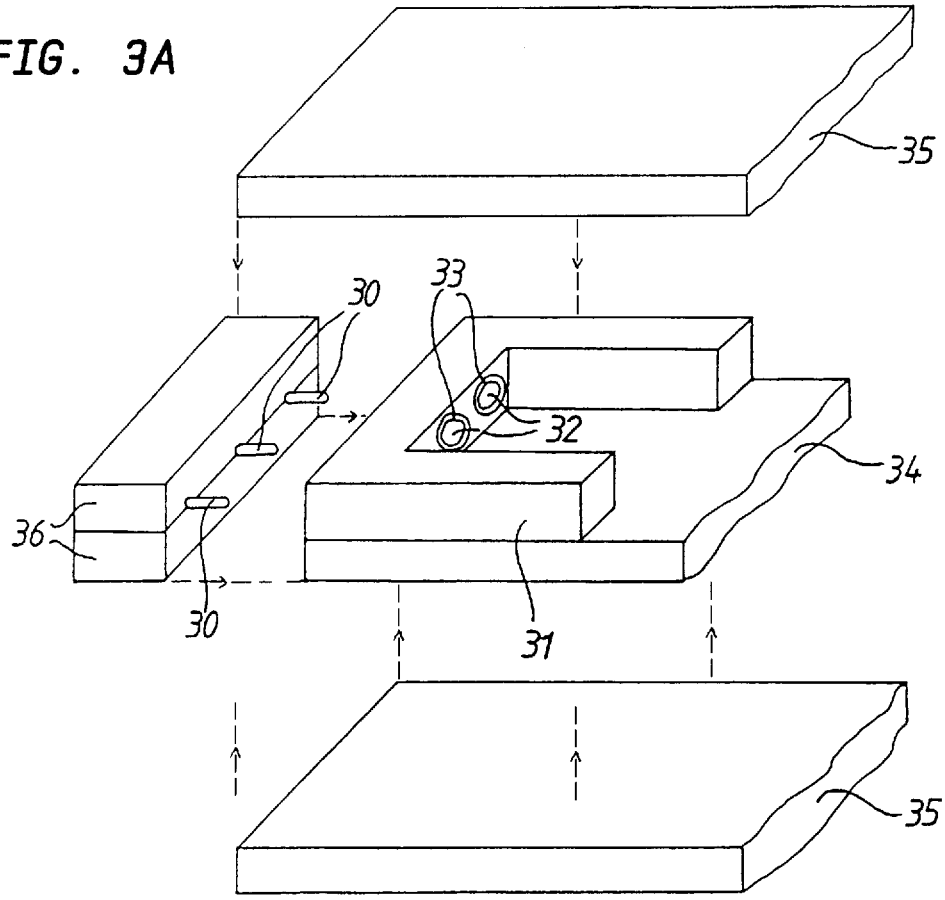
FIGS. 3*a, b* are a perspective view and a vertical section of a MMC component, with metal components being cast therein.
Figure 3B:
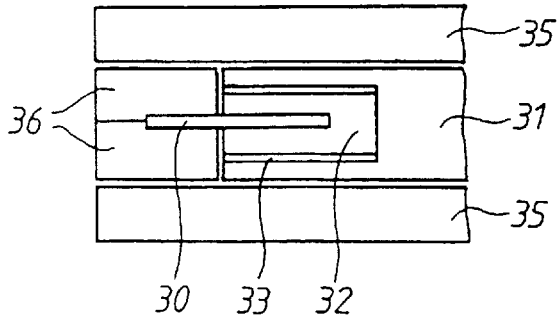

An actual exemplified application is shown in FIGS. 3*a, b*. Here, a housing which is open at the top, is to be made as MMC component. This is accomplished by placing a frame 31 made of Kovar on a preform plate 34. This frame 31 is provided with openings 32 through which openings 32 pins 30 made of Kovar are passed through to form electrical connections. Ceramic sleeves 33 are placed in the openings 32 for isolating the Kovar pins 30 from the frame 31. Since Kovar, as stated above, tends to oxidize during the heat-up phase which precedes the infiltration process, the Kovar components are protected from the effects caused by oxygen through near-by arrangement of oxygen-binding materials 35, 36. In the example of FIGS. 3*a, b* the oxygen-binding materials are formed, on the one hand, as plates 35 and, on the other hand, as strips which hold the pins 30 during the infiltration process, with the oxygen-binding materials 35, 36 being made from any oxygen-binding material such as e.g. graphite, carbon, or the like.

I claim:

1. A method of making MMC components, comprising the steps of:

placing a preform assembly in the presence of an oxygen-binding material of any kind in a pressure container within a crucible, with the preform assembly being formed by one of the arrangements selected from the group consisting of a first arrangement comprised of a preform and a preform holder which receives the preform and is made of a material which is capable of binding oxygen, thereby forming the oxygen-binding material, and a second arrangement comprised of a preform placed directly in the crucible, with the crucible having an inner wall coated with the oxygen-binding material;

allowing molten infiltration metal of any kind to so cover the preform assembly as to enclose the preform assembly and the oxygen-binding material to seal the preform assembly and the oxygen-binding material from the surrounding atmosphere to thereby allow binding of oxygen entrapped in pores of the preform assembly with the oxygen-binding material, without infiltration taking place; and subsequently infiltrating the preform with infiltration metal by applying a pressure in the pressure container.

2. The method of claim 1 wherein the oxygen-binding material is formed by a material selected from the group consisting of graphite, carbon, and metal.

3. The method of claim 2 wherein the metal is selected from the group consisting of zirconium and titanium.

4. The method of claim 1 wherein the oxygen-binding material is a porous oxygen-binding material, exhibiting pores filled with $H_2$.

5. The method of claim 1, and further comprising a form piece of oxygen-binding material disposed upon the infiltration metal.

6. The method of claim 1, and further comprising a sheath of oxygen-binding material surrounding the crucible.

7. The method of claim 1 wherein the infiltration metal is made of a metal selected from the group consisting of aluminum, copper, magnesium, silicon, iron, titanium, and alloys thereof.

8. The method of claim 5 wherein the infiltration metal is partially covered by the form piece made of oxygen-binding material.

9. A method of making MMC components, comprising the steps of:

placing a preform in a pressure container within a crucible in such a manner that a body of an oxygen-binding material is disposed in close proximity about the preform;

allowing molten infiltration metal of any kind to so cover the preform as to enclose the preform and the oxygen-binding material to seal the preform assembly and the oxygen-binding material from the surrounding atmosphere to thereby allow binding of oxygen entrapped in pores of the preform with the oxygen-binding material, without infiltration taking place; and subsequently infiltrating the preform with infiltration metal by applying a pressure in the pressure container.

10. The method of claim 9 wherein the preform is placed in a preform holder received in the crucible and made of a material which is capable of binding oxygen, thereby forming the oxygen-binding material.

11. The method of claim 9 wherein the oxygen-binding material is formed by a coating applied on an inner wall of the crucible.

* * * * *